US008528703B2

(12) United States Patent
Husmann

(10) Patent No.: US 8,528,703 B2
(45) Date of Patent: Sep. 10, 2013

(54) ELEVATOR SYSTEM WITH BOTTOM TENSIONING APPARATUS

(75) Inventor: Josef Husmann, Lucerne (CH)

(73) Assignee: Inventio AG, Hergiswil (CH)

( * ) Notice: Subject to any disclaimer, the term of this patent is extended or adjusted under 35 U.S.C. 154(b) by 359 days.

(21) Appl. No.: 12/999,672

(22) PCT Filed: Jun. 19, 2009

(86) PCT No.: PCT/EP2009/057699

§ 371 (c)(1),
(2), (4) Date: Dec. 17, 2010

(87) PCT Pub. No.: WO2009/153353

PCT Pub. Date: Dec. 23, 2009

(65) Prior Publication Data

US 2011/0088980 A1 Apr. 21, 2011

(30) Foreign Application Priority Data

Jun. 19, 2008 (EP) ..... 08158617

(51) Int. Cl.
*B66B 7/08* (2006.01)

(52) U.S. Cl.
USPC ..... 187/411; 187/249

(58) Field of Classification Search
USPC ..... 187/247, 251, 254, 264, 267, 278, 187/343–345, 351, 373, 376, 391–393, 411, 187/414
See application file for complete search history.

(56) References Cited

U.S. PATENT DOCUMENTS

| | | | | |
|---|---|---|---|---|
| 3,653,467 | A | 4/1972 | Showalter | |
| 4,230,205 | A * | 10/1980 | Darwent | 187/265 |
| 4,522,285 | A | 6/1985 | Salmon et al. | |
| 5,217,091 | A * | 6/1993 | Shiina et al. | 187/351 |
| 5,513,724 | A * | 5/1996 | De Jong | 187/264 |
| 5,861,084 | A * | 1/1999 | Barker et al. | 187/264 |
| 7,357,226 | B2 * | 4/2008 | Sakita | 187/249 |
| 7,610,994 | B2 * | 11/2009 | Green | 187/251 |
| 7,806,237 | B2 * | 10/2010 | Aulanko et al. | 187/265 |
| 2003/0155185 | A1 * | 8/2003 | Nomura et al. | 187/266 |
| 2011/0203878 | A1 * | 8/2011 | Kawakami | 187/247 |
| 2011/0290591 | A1 * | 12/2011 | Spirgi | 187/247 |
| 2012/0175194 | A1 * | 7/2012 | Nikawa | 187/376 |

FOREIGN PATENT DOCUMENTS

| | | |
|---|---|---|
| EP | 0619263 A2 | 10/1994 |
| JP | 2006264846 | 10/2006 |

* cited by examiner

*Primary Examiner* — Anthony Salata
(74) *Attorney, Agent, or Firm* — Fraser Clemens Martin & Miller LLC; William J. Clemens

(57) ABSTRACT

An elevator system includes an elevator car and a counterweight fixed to a traction device. A drive pulley moves the traction device. A bottom tensioning apparatus is fixed to the counterweight and to the elevator car. A tensioning weight tensions the bottom tensioning apparatus. In an end position of the counterweight, the elevator car can continue to move when the traction device is moved further by the drive pulley. This moves the tensioning weight at half the speed of the elevator car, for example. A measuring device is provided for the tensioning weight for detecting such a motion of the tensioning weight. This allows a triggering of an emergency stop of the elevator car.

13 Claims, 4 Drawing Sheets

ELEVATOR SYSTEM WITH BOTTOM TENSIONING APPARATUS

FIELD OF THE INVENTION

The invention relates to an elevator system with at least one elevator car drivable by a drive pulley by way of a traction means, wherein apart from the traction means a bottom tensioning means or apparatus, which is tensioned by a tensioning means weight, for the elevator car is provided. In particular, the invention relates to the field of elevator systems in which the occurrence of slip of the traction means at the drive pulley is prevented. In addition, the invention also relates to a method of operating such an elevator installation.

BACKGROUND OF THE INVENTION

An elevator system with an elevator car, a counterweight and a traction means, which connects the elevator car with the counterweight, is known from EP 0 619 263 A1. In that case the movement of the drive pulley is transmitted by way of the traction means to the elevator car and the counterweight. Also provided are tensioning means by way of which the elevator car is acted on against the force of the counterweight by a tensioning force. In the case of, in particular, high-rise elevator systems it is thereby possible to provide compensation for imbalance, which arises due to the weight of the traction means, at the drive pulley so that slip of the traction means at the drive pulley is prevented and the loading of a drive motor unit driving the drive pulley is reduced.

The elevator system known from EP 0 619 263 A1 has the disadvantage that in a state in which the counterweight rests in its end setting on a buffer a further raising of the elevator car is possible. Particularly in the case of elevator systems of very high construction the weight of the traction means, which engages the drive pulley from the side of the counterweight, can be sufficient to ensure the friction, which required for raising the elevator car, at the drive pulley. Since this represents a significant safety risk, the constructional height of known elevator systems is, for safe operation, limited.

SUMMARY OF THE INVENTION

An object of the invention is to create an elevator system in which safety is improved and which, in particular, an excessive lifting of an elevator car is prevented.

It is to be noted that the traction means also has the function, apart from transmission of the force or torque of a drive motor unit to the elevator car in order to actuate the elevator car, of supporting the elevator car. By actuation of the elevator car there is understood, in particular, raising or lowering of the elevator car, wherein the elevator car can be guided by one or more guide rails.

It is advantageous that a measuring device detects a vertical movement of the tensioning means weight and outputs a measurement variable, particularly a measurement voltage. For that purpose the measuring device comprises travel, speed or acceleration detecting means. In the present case use is preferably made of a measuring device with speed detecting means or a speed detecting device. The measurement voltage issued by the speed detecting device in that case proportionally increases with increasing vertical speed of the tensioning means weight. The detection of the speed of the tensioning means weight has the advantage that changes in length, which occur over relatively lengthy periods of time, of the tensioning means weight have no influence on the detection. For example, the length of the traction means and the length of the bottom tensioning means can increase due to the permanent load, which can lead to changes in position of the tensioning means weight. However, movement of the elevator car, which is not in accordance with operation, relative to the counterweight when, for example, the counterweight is stationary has the effect of movement of the tensioning means weight, so that detection of the speed of the tensioning means weight makes possible the detection of an undesired operating state regardless of the initial position of the tensioning means weight.

It is advantageous if the speed detecting device comprises a magnet rod, which is constructed at least in part to be magnetic, and at least one coil element, which surrounds the magnet rod in sections, and if the magnet rod and the coil element are so arranged that a movement of the tension means weight causes a relative movement between the magnet rod and the coil element. The magnet rod can, for example, be connected by means a bracket or the like with the tensioning means weight so that the magnet rod moves together with the tensioning means weight. The coil element can in this case be arranged in stationary position and, for example, be connected by way of a support with a floor or wall of an elevator shaft or another form of boundary of the travel region of the elevator car, such as, for example, a foundation of a framework construction.

In advantageous manner, a control device is provided which is connected with the speed detecting device, wherein the control device stops the elevator car when a threshold value is exceeded. This threshold value is predetermined with respect to a maximum permissible speed of movement of the tensioning means weight. In operation of the elevator system specific relatively small movements of the tensioning means weight can arise in operation of the elevator system when, for example, the elevator car starts off or the counterweight runs against a hydraulic buffer. Moreover, vibrations can propagate to the tensioning means weight. It is possible by the threshold value to reliably prevent response of a safety device in such normal cases. In the event of exceeding of the threshold value, the control device can, for example, actuate a safety relay for a safety chain for triggering an emergency stop. The threshold value is, in particular, fixable at such a level that the speed detecting device responds when the elevator car or the counterweight travels onto a buffer or when the elevator car or counterweight is blocked.

It is also advantageous if the speed detecting device is connected with an evaluating device and that the control device is connected by means of a bus system with the evaluating device connected with the speed detecting device. The detected speed of the tensioning means weight or a measurement variable correlated with the speed of the tensioning means weight can be issued by way of the bus system to the control device. In addition, the control device can also access the evaluating device and, by way of this, optionally the speed detecting device in order to, for example, perform a function check.

It is advantageous if a second elevator car and a second counterweight associated with the second elevator car, which are suspended at a second traction means connected with the second elevator car and the second counterweight, are provided. In addition, a second bottom suspension means is suspended on the one hand at the second counterweight and on the other hand at the second elevator car. Similarly, a second tensioning means weight which tensions the second bottom tensioning means is provided. Finally, a second measuring device is provided, preferably a second speed detecting device, for the second tensioning means weight and serves for detecting movement of the second tensioning means weight. The safety equipment can thus be used even with elevator systems with two elevator cars and, in corresponding manner, also with elevator systems with more than two elevator cars.

DESCRIPTION OF THE DRAWINGS

Preferred embodiments of the invention are explained in more detail in the following description by way of the accompanying drawings, in which corresponding elements are provided with corresponding reference numerals and in which.

DESCRIPTION OF PREFERRED EMBODIMENTS

Figure 1:
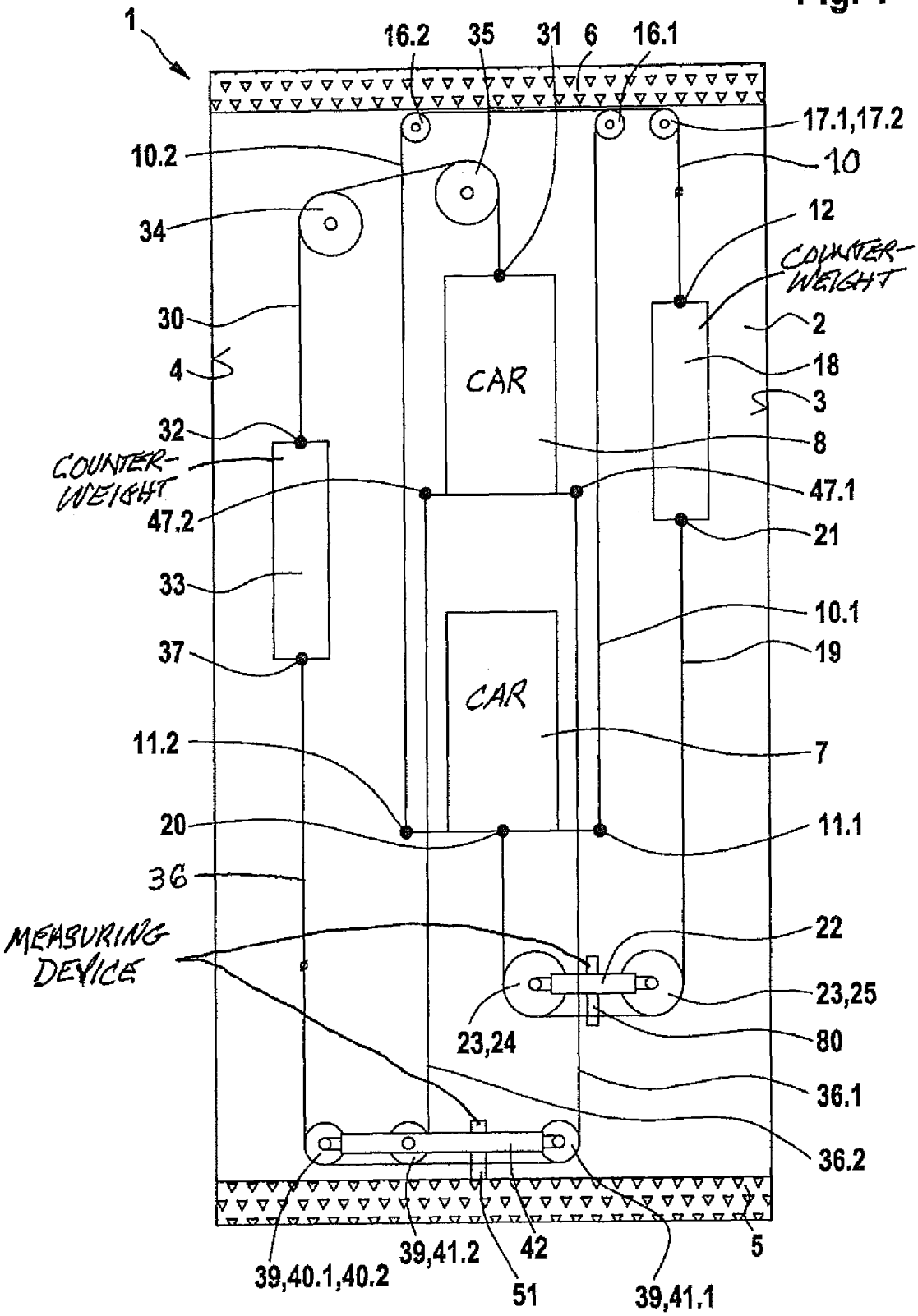
FIG. 1 shows an elevator system with two elevator cars in a schematic illustration in correspondence with a first embodiment of the invention.

FIG. 1 shows an elevator system 1 which is arranged in an elevator shaft 2 bounded by lateral walls 3, 4 as well as a floor 5 and a ceiling 6. The elevator system 1 can, in particular, be of very high construction and, for example, have an elevator shaft 2 with a height of 300 meters or more.

The elevator system 1 comprises a first elevator car 7 and a second elevator car 8, wherein the first elevator car 7 is arranged below the second elevator car 8. The two elevator cars 7, 8 are movable upwardly and downwardly independently of one another along a travel path usable by both elevator cars 7, 8. In that case the travel path is disposed in the elevator shaft 2, wherein one or more elevator car guide rails or the like can be provided, which for simplification of the schematic illustration are not illustrated.

The lower, first elevator car 7 is suspended at a traction means or device 10 with two traction means runs 10.1, 10.2 in substantially point-symmetrical manner with diagonally opposite force introduction regions and in the ratio 1:1. The traction means 10 also has the function of a support means. The first traction means run 10.1 of the first elevator car 7 has a first end 11.1 and a second end 12, which are fastened to the elevator car 7 and an associated counterweight 18, respectively. In that case a first auxiliary roller 16.1, around which the first traction means run 10.1 is guided, is mounted in the upper region of the elevator shaft 2 in the vicinity of the ceiling 6. Moreover, the first traction means run 10.1 runs around a first drive pulley 17.1, which is similarly mounted in stationary position in the vicinity of the ceiling 6 at the top in the elevator shaft 2, i.e. is connected with a drive motor unit fastened in the elevator shaft 2. From the first drive pulley 17.1 the first traction means run 10.1 finally runs to the associated counterweight 18, to which the first traction means run 10.1 is fastened.

The second traction means run 10.2 of the first elevator car 7 has a first end 11.2 and a second end 12, which are fastened to the elevator car 7 and the associated counterweight 18, respectively. In that case a second auxiliary roller 16.2, around which the second traction means 10.2 is guided, is mounted at the upper region of the elevator shaft 2 in the vicinity of the ceiling 6. Moreover, the second traction means run 10.2 runs around a second drive pulley 17.2, which is similarly mounted in stationary position in the vicinity of the ceiling 6 at the top in the elevator shaft 2, i.e. is connected with a drive motor unit fastened in the elevator shaft 2. From the second drive pulley 17.2 the second traction means run 10.2 finally runs to the associated counterweight 18, to which the second traction means run 10.2 is fastened.

The first and second drive pulleys 17.1, 17.2 preferably lie on a common drive axis. In a particularly preferred embodiment the two drive pulleys 17.1, 17.2 are constructed as an integral drive pulley, which has corresponding guide grooves for receiving the two traction means runs 10.1, 10.2. In both preferred embodiments the two drive pulleys 17.1, 17.2 or the integral drive pulley is or are drivable by a drive motor unit.

In addition, a bottom tensioning means or device 19 is provided, wherein a first end 20 of the bottom tensioning means 19 is suspended at the bottom at the first elevator car 7 and a second end 21 of the bottom tensioning means 19 is suspended at the bottom at the first counterweight 18. The bottom tensioning means 19 is tensioned by means of a tensioning means weight 22. For this purpose, a roller arrangement 23 with rollers 24, 25 is provided, the arrangement being connected with the tensioning means weight 22 so that the bottom tensioning means 19 runs around the roller arrangement 23.

The second elevator car 8 is centrally suspended at a second traction means or device 30, which also serves as support means, in a 1:1 suspension. A first end 31 of the traction means 30 is fastened to the second elevator car 8, preferably at the ceiling thereof. A second end 32 of the traction means 30 is fastened at the top to a second counterweight 33, which is associated with the second elevator car 8. In addition, the traction means 30 is guided around an auxiliary roller 34 and around a drive pulley 36, wherein the drive pulley 35 is arranged at the top in the elevator shaft 2 in the region of the ceiling 6 and is connected with a fixedly mounted drive motor unit.

Moreover, a second bottom tensioning means or device 36 with two tensioning means runs 36.1, 36.2 is provided. A first end 37 of the first and second tensioning means runs 36.1, 36.2 is fastened to a second associated counterweight 33. From its first end 37, the first and second tensioning means runs 36.1, 36.2 are guided around a roller arrangement 39, which receives a second tensioning means weight 42. The first tensioning means run 36.1 is in that case guided by two rollers 40.1, 41.1. The second tensioning means run 36.2 is guided by two further rollers 40.2, 41.2. In addition, a second end 47.1 of the first tensioning means run 36.1 as well as a second end 47.2 of the first tensioning means run 36.2 are fastened to the underside of the second elevator car 8 in substantially point-symmetrical manner with diagonally opposite fastening points.

The tensioning means weight 22 is associated with the first elevator car 7. The second tensioning means weight 42 is associated with the second elevator car 8. In addition, the tensioning means weights 22, 42 are arranged in the region of the floor 5 of the elevator shaft 2, i.e. at the bottom in the elevator shaft 2.

A measuring device 80 for the tensioning means weight 22 is associated with the tensioning means weight 22. In addition, a measuring device 51 for the tensioning means weight 42 is associated with the tensioning means weight 42. The measuring devices 80, 61 are schematically illustrated in FIG. 1, wherein the embodiment is also explained in further detail on the basis of FIGS. 2 to 6 by way of possible embodiments of the measuring device as a speed detecting device 80.

In further variants of embodiment the measuring devices 80, 51 can also be designed as position detecting or acceleration detecting devices. For this purpose the measuring devices 80, 51 are equipped with position or acceleration detecting means such as, for example, position transmitters or light barriers on the one hand or acceleration or inertia sensors on the other hand.

Figure 2:
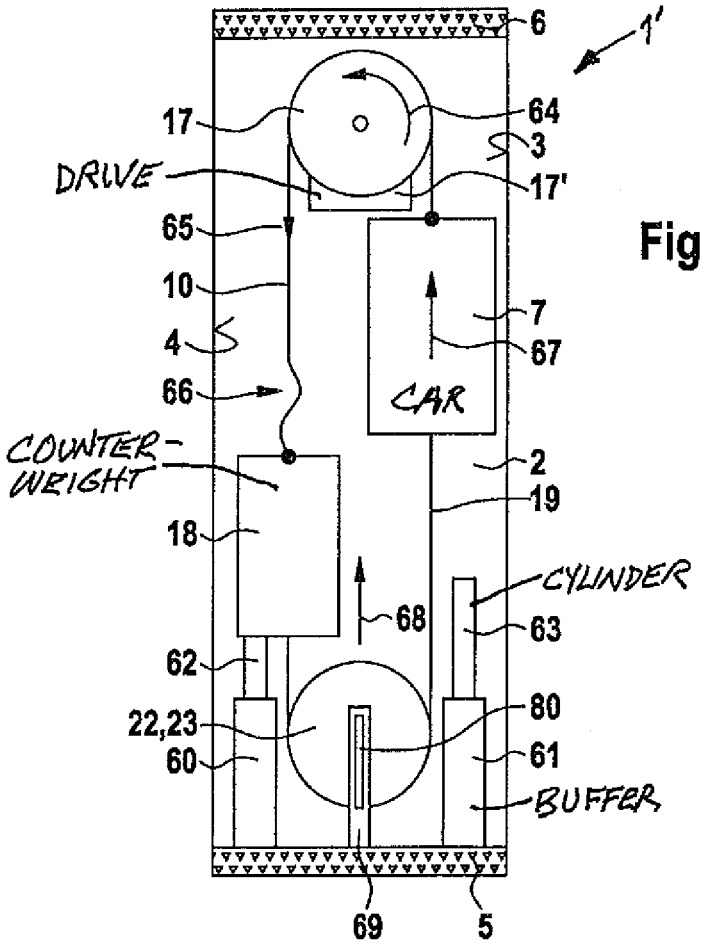
FIG. 2 shows an elevator system with an elevator car in a schematic illustration in correspondence with a second embodiment of the invention.

FIG. 2 shows an elevator system 1' in correspondence with a second exemplifying embodiment of the invention in a schematic illustration. The elevator system 1' in this exemplifying embodiment comprises an elevator car 7 which is connected with the counterweight 18 by way of the traction means 10. The traction means 10 runs over the drive pulley 17, which is connected with a drive motor unit 17' mounted in stationary position.

Buffer devices 60, 61, from each of which a respective hydraulically damped cylinder 62 or 63 projects, are arranged in the elevator shaft 2. In that case, in FIG. 2 a situation is illustrated in which the counterweight 18 is deposited on the cylinder 62 of the buffer device 60, wherein during the deposit a deceleration of the counterweight 18 is carried out in order to prevent an abrupt impact with the buffer device 60. Moreover, the drive pulley 17 rotates in the rotational direction 64 so that a traction force is exerted on the traction means 10 in the rotational direction 64.

When the counterweight 18 rests by way of the cylinder 62 on the buffer device 60 then the length of traction means 10 between the counterweight 18 and the drive pulley 17 is relieved of load. In the case of conventional elevator systems 1 of low construction the traction means 10 can slip through at the drive pulley 17 due to the relief of load. However, in the case of elevator systems 1 of high construction in which the elevator shaft 2 has, for example, a height of approximately 300 meters, the length of the traction means 10 between the counterweight 18 and the drive pulley 17 already has a high intrinsic weight. This intrinsic weight acts in a direction 65 on the traction means 10 in the region of the drive pulley 17. A slack cable 66 or the like thereby forms, as is illustrated in FIG. 2. The elevator car 7 is in that case raised further upwardly in a direction 67, although the counterweight 18 is already stationary. The formation of slack cable 66 or the like can also take place already during the deceleration of the counterweight 18, which is caused by pressing of the hydraulically damped cylinder 62 into the buffer device.

The formation of slack cable 66 or the like, i.e. an over-traction, can occur in the case of use of polyurethane-encased cables as traction means 10 or in the case of use of wedge-ribbed belts as traction means 10 even with relatively low build heights of the elevator installation 1, for example in the case of build heights of approximately 100 meters or approximately 30 meters. In the case of polyurethane-encased traction means use can also be made of aramid fibers. The occurrence of over-traction is therefore promoted by high build heights of the elevator system 1 and by a relatively large friction between the drive pulley 17 and the traction means 10.

Since the counterweight 18 is at rest, but the elevator car is actuated further in the direction 67, the tensioning means weight 22 with the roller arrangement 23 moves at half the speed of the elevator car 7 in a direction 68. The movement in the direction 68 can in that case even begin during deceleration of the counterweight 18.

A critical state arises if with deposited counterweight 18 increasing slack cable 66 or the like is formed. In this case the tensioning means weight 22 together with the roller arrangement 23 moves in the direction 68 at half the speed of the elevator car 7. The measuring device 80, which is fastened on the one hand to a guide 69 for the tensioning means weight 22 and on the other hand to the tensioning means weight 22, serves for detecting the movement of the tensioning means weight 22. The design of the measuring device 80 as a speed detecting device 80 is explained in the following in further detail with reference to FIGS. 3 to 6.

Figure 3:
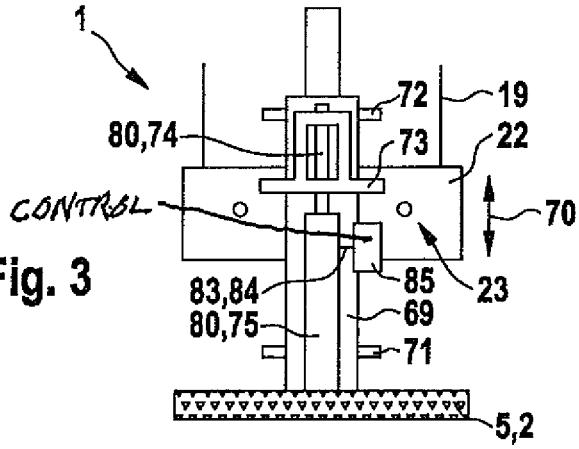
FIG. 3 shows an illustration, in the form of a detail, of an elevator system which shows, inter alia, a tensioning means weight.

FIG. 3 shows a detail illustration of an elevator system 1, which depicts a tensioning means weight 22 in a guide 69. The guide 69 is connected with the floor 5 of the elevator shaft 2. Moreover, in this exemplifying embodiment the roller arrangement 23 is integrated in the tensioning means weight 22. The tensioning means weight 22 is guided by the guide 69, wherein it is movable upwardly and downwardly as is illustrated by the double arrow 70. The movement of the tensioning means weight 22 is in that case limited by a lower abutment 71 and an upper abutment 72.

A bracket 73 is fastened to the tensioning means weight 22. A magnet rod 74, which is at least partly of magnetic construction and which is arranged in sections in a protective tube 75, is connected with the bracket 73. The protective tube 75 is connected with a support of the guide 69. The magnet rod 74 together with the tensioning means weight 22 thus moves, but the protective tube 75 is arranged in stationary position. A movement of the tensioning means weight 22 in a direction 70 therefore causes a relative movement between the magnet rod 74 and the protective tube 75. The magnet rod 74 and the protective tube 75 are part of a speed detecting device 80, which on the basis of this relative movement detects a movement of the tensioning means weight 22. The protective tube 75 of the speed detecting device 80 comprises coil elements 81, 82 (FIG. 5) which are connected by way of lines 83, 84 with a control device 85. The coil elements 81, 82 are in that case arranged within the protective tube 75.

Figure 4:
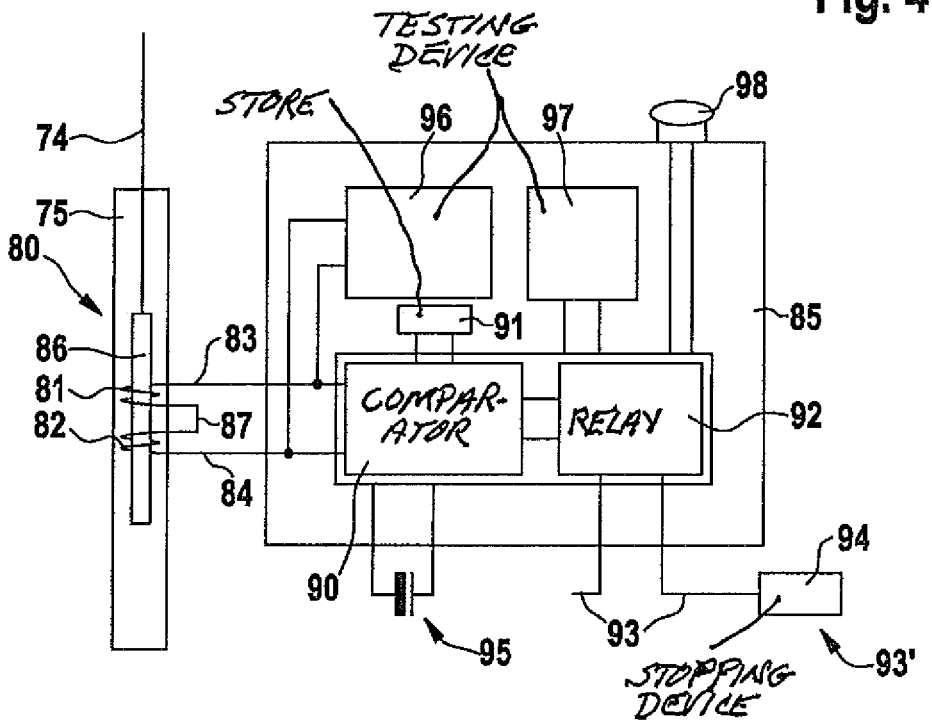
FIG. 4 shows a speed detecting device for the tensioning means weight shown in FIG. 3, with a control device in correspondence with one possible embodiment of the invention.

FIG. 4 shows a speed detecting device 80 for the tensioning means weight 22, which is shown in FIG. 3, with a control device 85 in correspondence with a possible embodiment of the invention. In that case, the magnet rod 74 has at least one magnetic section 86. The coil elements 81, 82 of the speed detecting device 80 are provided in the region of the magnetic section 86. The coil elements 81, 82 in this exemplifying embodiment are connected in series by way of a connecting line 87. In the case of a relative movement between the magnetic section 86 and the coil elements 81, 82, i.e. in the case of a movement of the tensioning means weight 22, a measurement variable in the form of a voltage or measurement voltage is generated between the lines 83, 84, as is explained in detail on the basis of FIG. 5. The coil elements 81, 82 are connected by way of the lines 83, 84 with a comparator 90, which is designed as a voltage comparator and which compares that between the lines 83, 84 with a threshold value voltage, which is provided by a settable threshold value store 91. The settable threshold value store 91 can be designed as, for example, a settable resistance. If the measurement voltage between the lines 83, 84 exceeds the threshold value voltage, then the comparator 90 activates a safety relay 92. The safety relay 92 is connected in a line 93 of a safety chain 93', wherein in the case of interruption of the safety chain 93' an emergency stopping device 94 obliges an emergency stop of the elevator car 7.

Moreover, a voltage supply 95 is provided for the control device 85. In addition, the control device 85 comprises a sensor testing device 96 serving for testing the functional capability of the speed detecting device 80. In particular, the sensor testing device 96 can check whether a current flow is possible by way of the lines 83, 84 as well as the coil elements 81, 82 and the connecting line 87. Furthermore, a self-testing device 97 is provided, by which a self-testing of the comparator 90 is possible. Furthermore, a manually actuable reset button 98 is provided. After triggering of an emergency stop by the emergency stopping device 94 an appropriate operative must be called for checking the elevator system. After the check, the speed detecting device 80 can be reset to its initial state by way of the reset button 98, whereby the safety relay 92 closes the safety chain 93'.

Alternatively or in addition, the speed detecting device 80 can be reset under remote control, for example by service personnel of a monitoring center. For that purpose the elevator system is connected by signal transmission means, such as a line or by radio, with the monitoring center.

Figure 5:
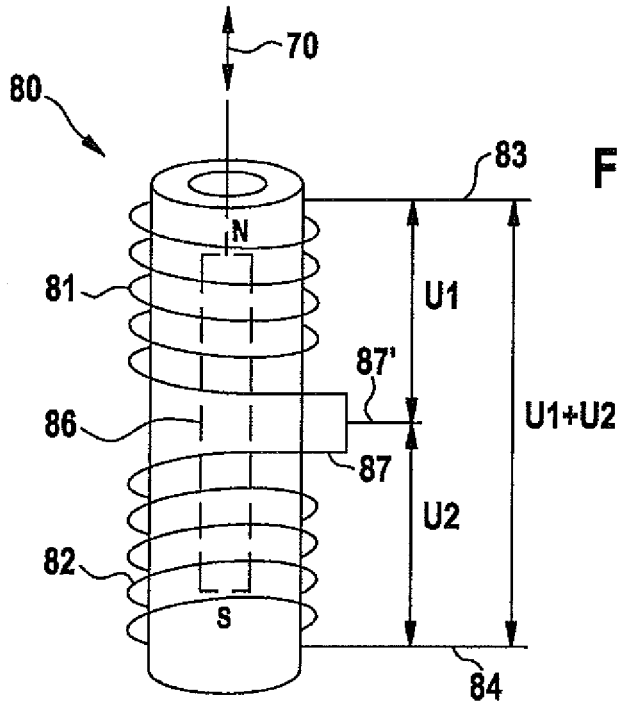
FIG. 5 shows the speed detecting device, which is shown in FIG. 4, in a detailed schematic illustration.

FIG. 5 shows a detail of the speed detecting device 80, which is shown in FIG. 4, in a detailed, schematic illustration. In that case the magnetic section 86 arranged within the coil elements 81, 82 is illustrated. On movement of the magnetic section 86 relative to the coil elements 81, 82, as is illustrated by the double arrow 70, induction voltages U1 and U2 are generated between the respective ends of the coil elements 81, 82 by magnetic induction. In this embodiment the coil elements 81, 82 are connected in series by way of the connecting line 87 so that the individual voltages U1 and U2 summate to a form a total voltage U1+U2. However, it is also possible for the induction voltages U1 and U2 to be separately evaluated by a control device 85. For this purpose, a line 87' can be additionally led to the control device 85. In a given case, it is also possible to provide, instead of one line 87', two lines 83', 84' (FIG. 6) so as to be able to evaluate the two induced voltages U1 and U2 completely separately from one another. Through the separate measurement of the induced voltages U1 and U2 of the coil elements 81, 82 safety can be increased as a consequence of redundancy and mutual comparison of the signals. In both cases the mode of function can be checked by a suitable sensor testing device 96.

The sum voltage U1+U2 can thus serve as measurement voltage for the speed detecting device 80 or use can be made of two measurement voltages, namely the individual voltages U1 and U2.

The design of the coil elements 81, 82 with respect to the magnetic section 86 can be such that the generated voltages U1 and U2 are at least substantially proportional to the speed of the tensioning means weight 22. This sensor has a high functional integrity, since it operates contactlessly and no electrical energy supply for the speed detecting device 80 is required. The voltage supply 95 for the control device 85 can be stored by battery or accumulator, wherein the activation of the safety relay 92 can be such that in the absence of functional capability, particularly in the case of failure of the supply voltage, the control device 85 interrupts the safety chain 93'.

The control device 85 can be designed without a microprocessor and corresponding software. A simpler construction is thereby possible and a high level of reliability can be guaranteed. If the speed of the tensioning means weight 22 is too high, particularly when the speed of the tensioning means weight 22 is equal to half the speed of the elevator car 7, then the safety relay 92 opens the safety chain 93'. The threshold value, which is required for this purpose, of the threshold value store 91 is set so low that response of the control device 85 takes place with consideration of a safety margin.

The length of the magnet rod 74 can, for example, be equal to the length of the possible stroke of the tensioning means weight 22 plus a specific length for fastening to the bracket 73. Damage of not only the magnet rod 74, but also the coil elements 81, 82 is prevented by the protective tube 75.

Figure 6:
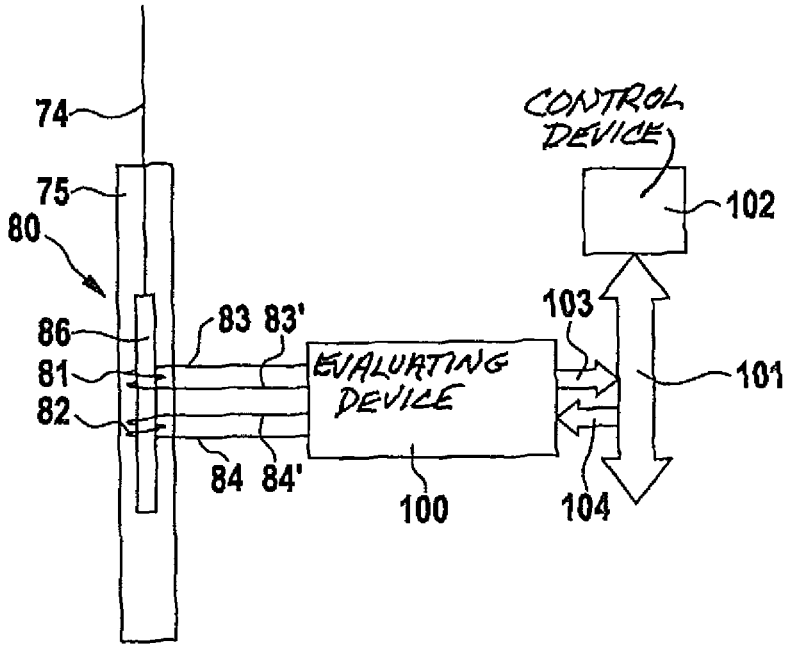
FIG. 6 shows a speed detecting device for the tensioning means weight, which is shown in FIG. 3, with an evaluating device connected with a control device by way of a bus system, in correspondence with another possible embodiment of the invention.

FIG. 6 shows the speed detecting device 80, which is illustrated in FIG. 4 and which is connected by way of an evaluating device 100 and a bus system 101 with a control device 102, in correspondence with a further possible embodiment of the invention. In this exemplifying embodiment the coil elements 81, 82 are connected with the evaluating device 100 by way of the lines 83, 83' or 84, 84'. The induced voltages U1, U2 can be separately detected by the separate connection of the coil elements 81, 82 with the evaluating device 100, whereby safety is improved. The evaluating device 100 evaluates the induced voltages U1, U2, for example by means of a suitable analog-to-digital converter, and issues these data by way of the bus system 101 with respect to, for example, a bus cycle of the bus system 101. In that case the evaluating device 100 can be connected at one side, as is illustrated by the data arrow 103, with the bus system 101. However, it is also possible for the evaluating device 100 to receive data from the bus system 101, as is illustrated by the data arrow 104. The evaluating system 100 is thus coupled at least in one direction with the bus system 101. In addition, the bus system 101 is linked with the control device 102, which can access data transmitted by way of the bus system 101 and can transmit data by way of the bus system 101 to further devices, particularly to the evaluating device 100. The control device 102 can evaluate the data obtained from the evaluating device 100 and in a given case cause an emergency stop of the elevator car 7.

In that case it is also possible for the evaluating device 100 to already undertake a far-reaching evaluation of the induced voltages U1 and U2 of the coil elements 81, 82, wherein, in particular, the comparator 90 and a threshold value store 91, as are described on the basis of FIG. 4, can be integrated in the evaluating device 100. In this case the evaluating device 100 can report by way of the bus system 100 whether or not an emergency stop is required.

In the absence of data of the evaluating system 100 the control device 102 can thereby conclude that there is a fault in the evaluating device 100.

The invention is not restricted to the described embodiments.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having an elevator car and an associated counterweight that are suspended by at least one traction device, a drive pulley over which the traction device runs, at least one bottom tensioning device suspended at the counterweight and the elevator car, and a tensioning means weight tensioning the bottom tensioning device, comprising:

a speed detecting device for detecting a speed of movement of the tensioning means weight and generating a measurement value corresponding with the detected speed; and a control device for comparing the measurement value with a threshold value wherein said control device stops the elevator car when the measurement value exceeds the threshold value, and wherein the threshold value is predetermined with respect to a maximum permissible speed of the tensioning means weight.

2. The elevator system according to claim 1 wherein said speed detecting device comprises a magnet rod that is at least in part of magnetic construction, and at least one coil element surrounding a section of said magnet rod, and wherein said magnet rod and said at least one coil element are arranged whereby a movement of the tensioning means weight causes a relative movement between said magnet rod and said at least one coil element.

3. The elevator system according to claim 2 wherein said magnet rod is coupled with the tensioning means weight and said at least one coil element is arranged to be stationary relative to said magnet rod.

4. The elevator system according to claim 3 wherein said at least one coil element is arranged in a stationary protective tube and said magnet rod is moveable in and is guided by said protective tube.

5. The elevator system according to claim 1 wherein said control device comprises a voltage comparator which compares a measurement voltage that is output by said speed detecting device with a threshold value voltage, said control device having a safety relay of a safety chain for an emergency stop, and said safety relay is actuable by said voltage comparator.

6. The elevator system according to claim 1 wherein said speed detecting device is connected with an evaluating device and said control device is connected by a bus system with said evaluating device for data transmission in at least one direction.

7. The elevator system according to claim 1 wherein said speed detecting device comprises a magnet rod that is at least in part of magnetic construction, and a pair of coil elements each surrounding an associated section of said magnet rod, wherein said magnet rod and said coil elements are arranged whereby a movement of the tensioning means weight causes a relative movement between said magnet rod and said coil elements thereby generating induction voltages in each of said coil elements.

8. The elevator system according to claim 1 wherein said control device includes a comparator connected to said speed detecting device, a threshold value store storing the threshold value and being connected to said comparator, and a safety relay connected to said comparator, wherein said comparator compares the measurement value with the threshold value and activates said safety relay when the measurement value exceeds the threshold value.

9. The elevator system according to claim 8 wherein said control device includes a sensor testing device connected to said speed detecting device for testing a functional capability of said speed detecting device.

10. The elevator system according to claim 8 wherein said control device includes a self-testing device for testing operation of said comparator.

11. The elevator system according to claim 8 wherein said control device includes a manually resettable reset button for resetting said safety relay after activation.

12. An elevator system comprising:

a first elevator car and an associated first counterweight, which are suspended by at least a first traction device;

a first drive pulley over which said first traction device runs;

a first bottom tensioning device suspended at said first counterweight and said first elevator car;

a first tensioning means weight tensioning said first bottom tensioning device;

a first speed detecting device for detecting a first speed of movement of said first tensioning means weight in a direction of travel of said first elevator car and said first counterweight and generating a first measurement value corresponding with the first detected speed;

a second elevator car and an associated second counterweight, which are suspended by at least a second traction device;

a second bottom tensioning device suspended at said second counterweight and said second elevator car;

a second tensioning means weight tensioning said second bottom tensioning means;

a second speed detecting device for detecting of a second speed of movement of said second tensioning means weight in a direction of travel of said second elevator car and said second counterweight and generating a second measurement value corresponding with the second detected speed; and a control device for comparing the first and second measurement values with associated threshold values wherein said control device stops the elevator car when the measurement value exceeds the threshold value, and wherein the threshold value is predetermined with respect to a maximum permissible speed of the tensioning means weight.

13. A method of operating an elevator system having an elevator car and an associated counterweight suspended from a drive pulley by a traction device, a bottom tensioning device suspended at the counterweight and at the elevator car, and a tensioning means weight tensioning the bottom tensioning device, comprising the steps of:

a. detecting a speed of the tensioning means weight in a direction of movement of the elevator car and the counterweight;

b. comparing a measurement value corresponding to the detected speed with a threshold value;

c. predetermining the threshold value with respect a maximum permissible speed of the tensioning means weight; and d. stopping the elevator car when the threshold value is exceeded by the measurement value.

* * * * *